US005729849A

United States Patent [19]

Garakani

[11] Patent Number: 5,729,849

[45] Date of Patent: Mar. 24, 1998

[54] SECTIONAL BED APPARATUS

[76] Inventor: Mojtaba Garakani, 8009 Willet Trail, Austin, Tex. 78745

[21] Appl. No.: 794,911

[22] Filed: Feb. 4, 1997

Related U.S. Application Data

[63] Continuation-in-part of Ser. No. 351,782, Dec. 8, 1994, abandoned.

[51] Int. Cl.[6] ..... A61G 7/015; A61G 7/018; A61G 7/02

[52] U.S. Cl. ..... 5/618; 5/604; 5/613; 5/937

[58] Field of Search ..... 5/604, 611, 613, 5/616, 618, 937

[56] References Cited

U.S. PATENT DOCUMENTS

| | | | |
|---|---|---|---|
| 736,188 | 8/1903 | Wyssa . | |
| 769,579 | 9/1904 | Wright et al. . | |
| 926,033 | 6/1909 | Taylor et al. . | |
| 952,957 | 3/1910 | Sterling . | |
| 1,274,851 | 8/1918 | Byrd | 5/613 |
| 1,284,356 | 11/1918 | Johnson . | |
| 1,630,453 | 5/1927 | Smith . | |
| 3,945,063 | 3/1976 | Matsuura | 5/611 |
| 3,959,832 | 6/1976 | Parsons . | |
| 4,136,409 | 1/1979 | Ishida | 5/613 |
| 4,222,133 | 9/1980 | Csatary . | |
| 5,040,253 | 8/1991 | Cheng . | |
| 5,109,558 | 5/1992 | Di Blasi | 5/611 |
| 5,392,479 | 2/1995 | Liao | 5/618 |

FOREIGN PATENT DOCUMENTS

| | | | |
|---|---|---|---|
| 14138/28 | 10/1929 | Australia . | |
| 0671049 | 4/1952 | United Kingdom | 5/937 |

*Primary Examiner*—Rodney M. Lindsey
*Assistant Examiner*—Robert G. Santos
*Attorney, Agent, or Firm*—Shaffer & Culbertson; J. Nevin Shaffer, Jr.

[57] ABSTRACT

A sectional bed (10) having a bedframe (34), a mattress section holder (16) attached to the bedframe (34) and a number of independent mattress sections (14) for support, removably attachable to the mattress section holder (16). A traveling frame (36) movably connected to the bed (10) and a shuttle (48) connected to the traveling frame (36) for use in removing and replacing each of the several independent mattress sections (14) are provided. By this means, the ability to independently separately remove sections of the bed (10) is provided. As a result, this present invention eliminates and/or alleviates four of the major problems associated with the care of bedridden patients; those being: 1) bedsores; 2) bedpan usage; 3) linen changing; and 4) patient bathing.

4 Claims, 8 Drawing Sheets

SECTIONAL BED APPARATUS

This application is a continuation-in-part of application Ser. No. 08/351,782, filed Dec. 8, 1994, now abandoned.

BACKGROUND OF THE INVENTION

This invention relates to a sectional bed for use in the care and treatment of individuals confined to bed.

Hospital and nursing home staff currently face problems in four major areas in conjunction with the care of immobile and/or bedridden patients. These problems are: 1) bed sores; 2) bedpan usage; 3) changing soiled sheets; and 4) bathing the patient. As discussed hereafter, each of these problems is a source of serious concern. As evidenced by early twentieth century patents, the Wyssa invention, U.S. Pat. No. 736,188; the Wright et al. invention, U.S. Pat. No. 769,579; the Taylor et al. invention, U.S. Pat. No. 926,033; the Cox invention, U.S. Pat. No. 952,957; the Johnson invention, U.S. Pat. No. 1,284,356; the Smith invention, U.S. Pat. No. 1,630,453; and an Australian Patent, the Craig invention No. 14,138/28., efforts by inventors to alleviate the problems of positioning patients on beds has been the subject of considerable long-term research. These efforts continue today as evidenced by the Cheng invention, U.S. Pat. No. 5,040,253 with regards to the positioning of patients within a hospital bed framework. In particular, however, these patents were not directed to the problems previously outlined by the Applicant herein concerning bed sores, bedpan usage, changing sheets, and bathing the patient. Other, patents, however, have addressed some of these issues. In particular, the Parsons invention, U.S. Pat. No. 3,959,832 and the Csatary invention, U.S. Pat. No. 4,222,133 specifically disclose a sick bed hammock wherein holes in the hammock are provided for preventing the occurrence of bed sores and to facilitate bedpan usage. The problem is real because the constant contact of the patient's body with the bed and the resultant lack of air circulation between the bed and the patient's body leads to painful and agonizing sores. Other than moving the patient from the bed or providing holes in the mattress as the Parsons invention did, mattresses with peaks and valleys dispersed throughout the mattress is the only other "solution" known to the applicant. These prior art solutions are imperfect, however, in that, some portion of the patient's body will be in contact with the mattress at all times, even with these types of mattresses.

Bedpan usage requires the movement of the patient which often results in discomfort to the patient and similar inconvenience and distress to the nursing staff. Simply getting a patient into position to place the bedpan under the patient and moving the patient back to the patient's original position after utilizing the bedpan, takes an extraordinary amount of staff time and requires, typically, the patient to endure pain and discomfort during the process. As with each of these problems, a major concern in this area is obtaining the required necessary personnel in a timely matter to perform this task. Again, typically, the patient has to endure discomfort while waiting for the staff to attend to this particular need.

The changing of bed linen is often performed by two nurses or attendants who roll the patient to one side of the bed, roll and gather the soiled sheet toward the patient, and, then, roll the patient back to the other side of the bed so that the sheet is released from underneath the patient. To spread the clean linen on the bed, similar steps are required. The entire process, as is true of each of these problems, causes distress to the patient and discomfort to both the patient and the attending nurses and/or staff. With heavy and/or elderly patients, this changing of linens becomes more difficult, time consuming and, certainly, more painful for the patient.

Bathing the patient also requires a great deal of effort for the nursing staff and an equal amount of endurance for the patient. Due to the difficultly involved in bathing the patient, bathing may not occur as frequently as is necessary. In many cases, removing the patient from the bed for bathing is impossible.

Again, while there are manual and mechanical means for moving a patient on a bed and types of beds with raised and lowered portions in the mattress, none of the prior solutions to these difficult problems resulting from a patient's confinement to bed are satisfactory. Thus, there is a need in the art for providing a bed that effectively eliminates bed sore problems, enables toilet usage, and enables easy and frequent linen changes and bathing of the patient. It, therefore, is an object of this invention to provide a sectional bed that remedies these problems without requiring the patient to be removed from the bed itself.

SHORT STATEMENT OF THE INVENTION

Accordingly, the sectional bed of the present invention includes a bedframe and a mattress section holder attached to the bedframe. Additionally, a number of independent mattress sections for supporting the patient, are removably attached to the mattress section holder. By means of this invention then, a selected number of mattress sections can be temporarily removed from the bed thereby enabling use of the toilet, access for bathing, and the elimination of bed sores. Additionally, the independent mattress sections are individually wrapped so that changing of the linen is accomplished by the changing of the separate linen wrapped around each of the independent mattress sections. In this manner, only the soiled sections need be removed and replaced and not the entire mattress cover, as is the case in the prior art.

Additionally, in a preferred embodiment, the sectional bed of the invention includes a traveling frame movably connected to the headboard and the footboard of the bed and a shuttle connected to the traveling frame for use in removing and replacing, in any sequence desired by the user, each of the several independent mattress sections. The shuttle travels back and forth along the length of the traveling frame so as to be selectively positioned underneath each mattress section as it is needed to be removed or replaced. Still further, the shuttle contains a support platform that is movably attached to the shuttle. By this manner, the movable support platform can be positioned beneath the patient and used to support a toilet in the desired location. Additionally, as it has been noted previously, hospital beds are designed to flex the upper and lower torsos into positions of desired comfort for the patient. As a result, the present invention includes a mattress section holder that consists of a pair of oppositely positioned supports. Each of these oppositely positioned supports is constructed of a series of independently movable connected sections. As a result, as the bed is moved, again as it is known in the art, the mattress section holder flexes in the same manner and the individual mattress sections are moved accordingly.

Still further in a preferred embodiment, the mattress sections are all equal in length but some vary in width depending on their position on the bed. The individual mattress sections are each secured to a separate plate which is detachably connected to the mattress section holder and the mattress sections themselves can be removably attached to the plate.

BRIEF DESCRIPTION OF THE DRAWINGS

Other objects, advantages, and features of the present invention will become more fully apparent from the following detailed description of the preferred embodiment, the appended claims and the accompanying drawings in which:

DETAILED DESCRIPTION OF THE PREFERRED EMBODIMENT

The preferred embodiment of the present invention is illustrated by way of example in FIGS. 1–7. With specific reference to FIG. 1, a sectional bed 10 is disclosed that is a special type of bed to be used, in a preferred embodiment, for immobile patients and bedridden people. Its expected use would be hospitals, nursing homes, and in homes for home-care purposes. The sectional bed 10 of the present invention is especially designed to eliminate and/or alleviate problems, as described above, associated with the care of the bedridden as described above.

Figure 6A:
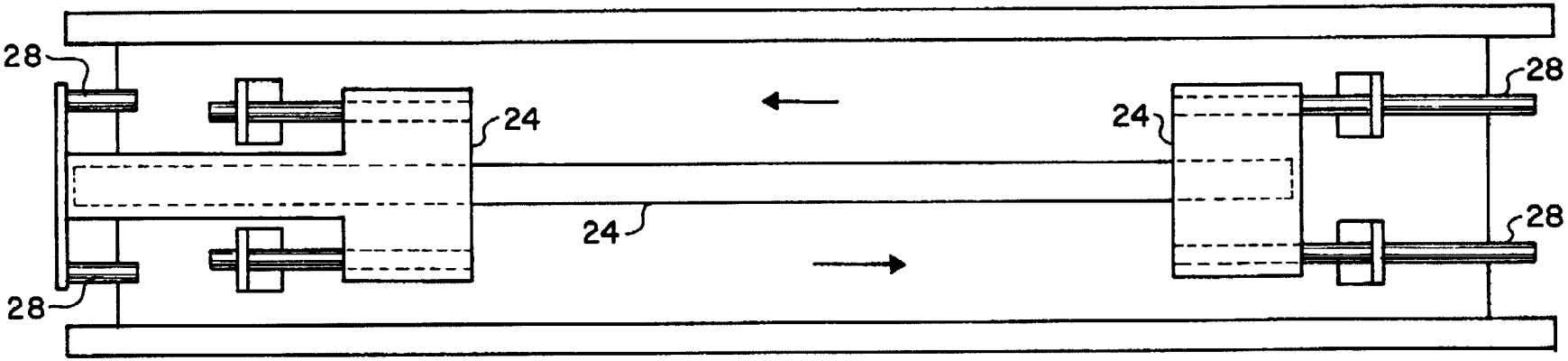
FIG. 6A shows the dual purpose locking mechanism attached to the bottom of the mattress section plate.

In general, the bed 10 is remotely operatable by the staff or by the patient. The bed 10 has the same general movements as typical hospital movable beds as far as raising the upper torso, thighs, and calves and, also, raising and lowering the entire bed. That is, all the elevations are adjustable. Importantly and uniquely, however, in present invention, the mattress 12 of the bed 10 is actually comprised of a number of sections 14 which are all equal in length but may vary in width. These mattress sections 14 are attached to a mattress section holder 16 and, once attached, form a mattress 12 of dimensions similar to an ordinary mattress. In this invention, however, each mattress section 14 is independently attached to, and detachable from, a mattress section holder 16. Further, each mattress section 14 is comprised of a plate 18 (see FIG. 2) which is made from metal, reinforced plastic or any other sturdy material that is desirable. Attached to the top of the plate 18 there is a layer of foam 20 (see FIG. 3) or any other soft material suitable for forming the mattress 12. Below the plate 18, there is a dual purpose locking mechanism 24 (see FIG. 6A) which is used to engage the mattress section 14 to the mattress section holder 16. The mattress section holder 16 has a number of holes 26 (see FIG. 6) along both its sides to accommodate securing the mattress sections 14. The engagement of the mattress sections 14 to the mattress section holder 16 is accomplished by sliding locking mechanism shafts 28 (two sets on each side) (see FIG. 6 and 6A) about one inch along the length of the mattress section 14 through these holes 26. The sliding of the locking mechanism shaft 28 can be accomplished either manually or automatically, i.e., electronically, pneumatically, hydraulically, etc. or by any means known in the art so that shafts 28 engage holes 26.

Figure 3:
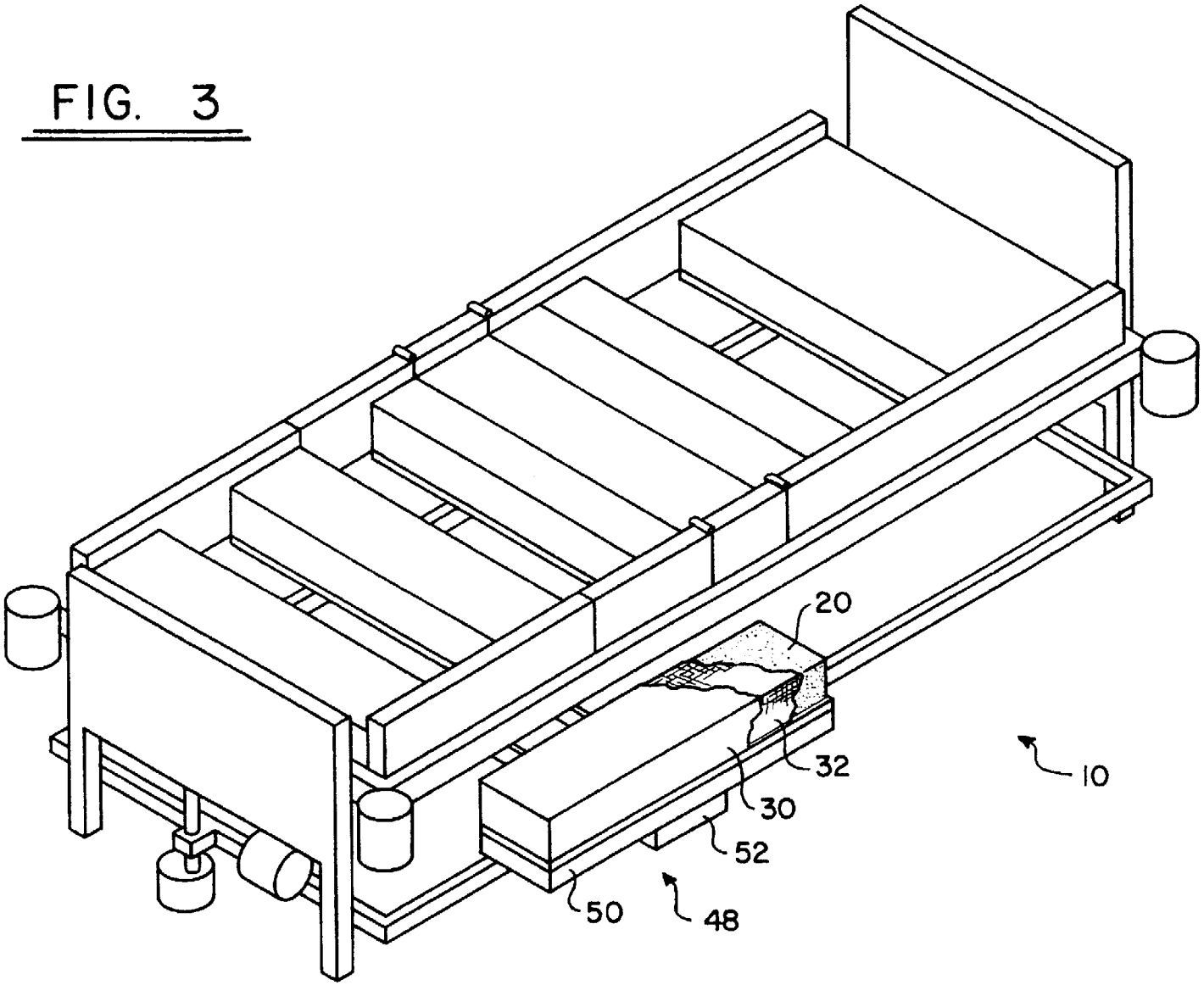
FIG. 3 shows the mattress section in FIG. 2 on the shuttle rotated ninety degrees so that it is parallel to the bed so that the linen can be changed.

Referring now to FIG. 3, each mattress section 14 has a separate cover sheet 30 sized and tailored to fit over the top of the mattress section 14 as an individual separate linen. In one embodiment, along an entire edge of the cover sheet 30, one side of hook and loop material is attached. The other side of the hook and loop material is attached along the length of both the bottom sections of the mattress section 14. The hook and loop material is used to secure the cover sheet 30 on the mattress section 14. Obviously, any other means of securing the linen known in the art and found desirable could be used as well. Under the cover sheet 30, a diapery material 32 known as "blue chuck" is used and covers the mattress section 14 to keep the mattress section 14 from being soiled.

Figure 1:
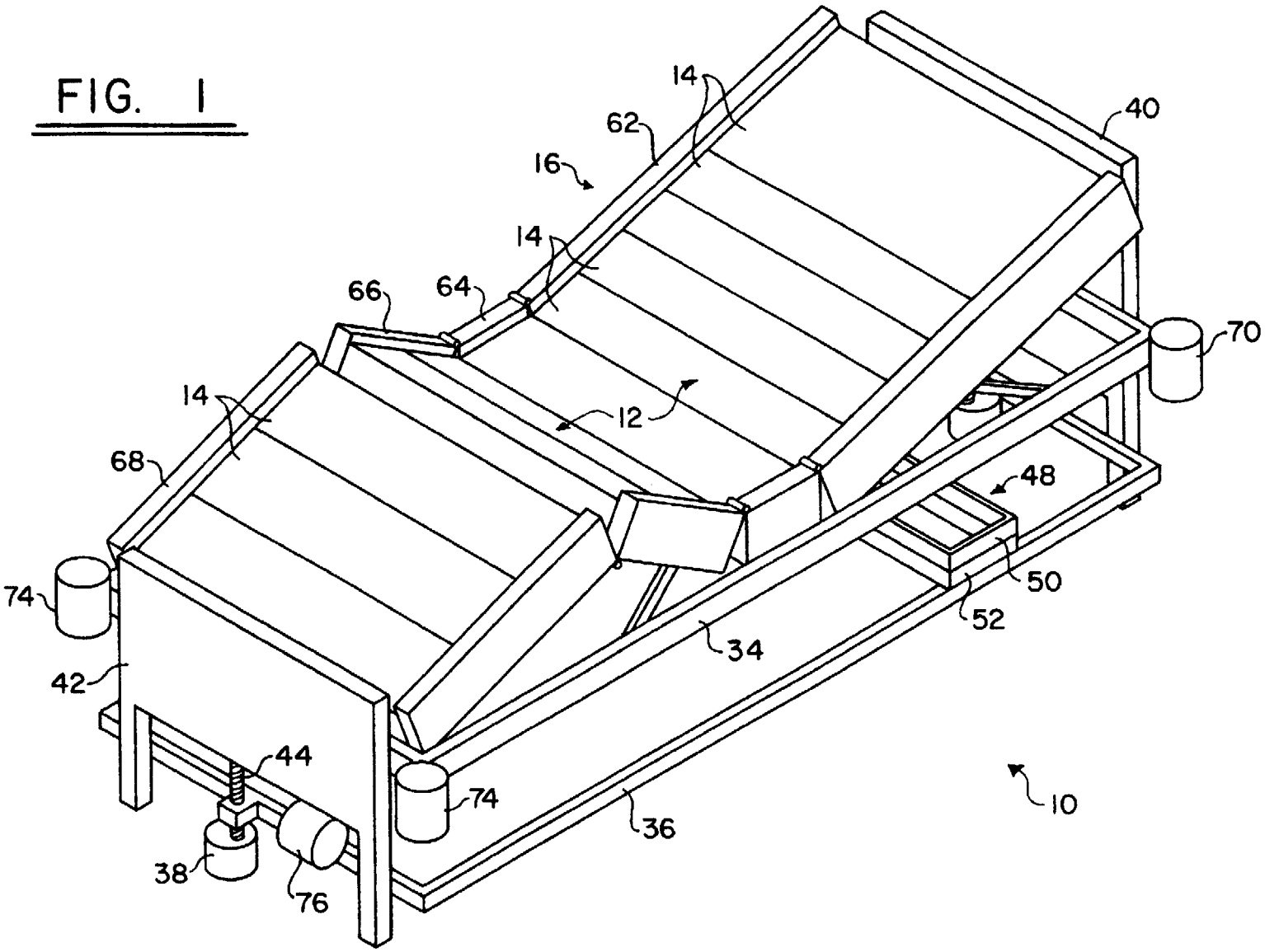
FIG. 1 is a plan view of the preferred embodiment of the sectional bed of the present invention.
Figure 2:
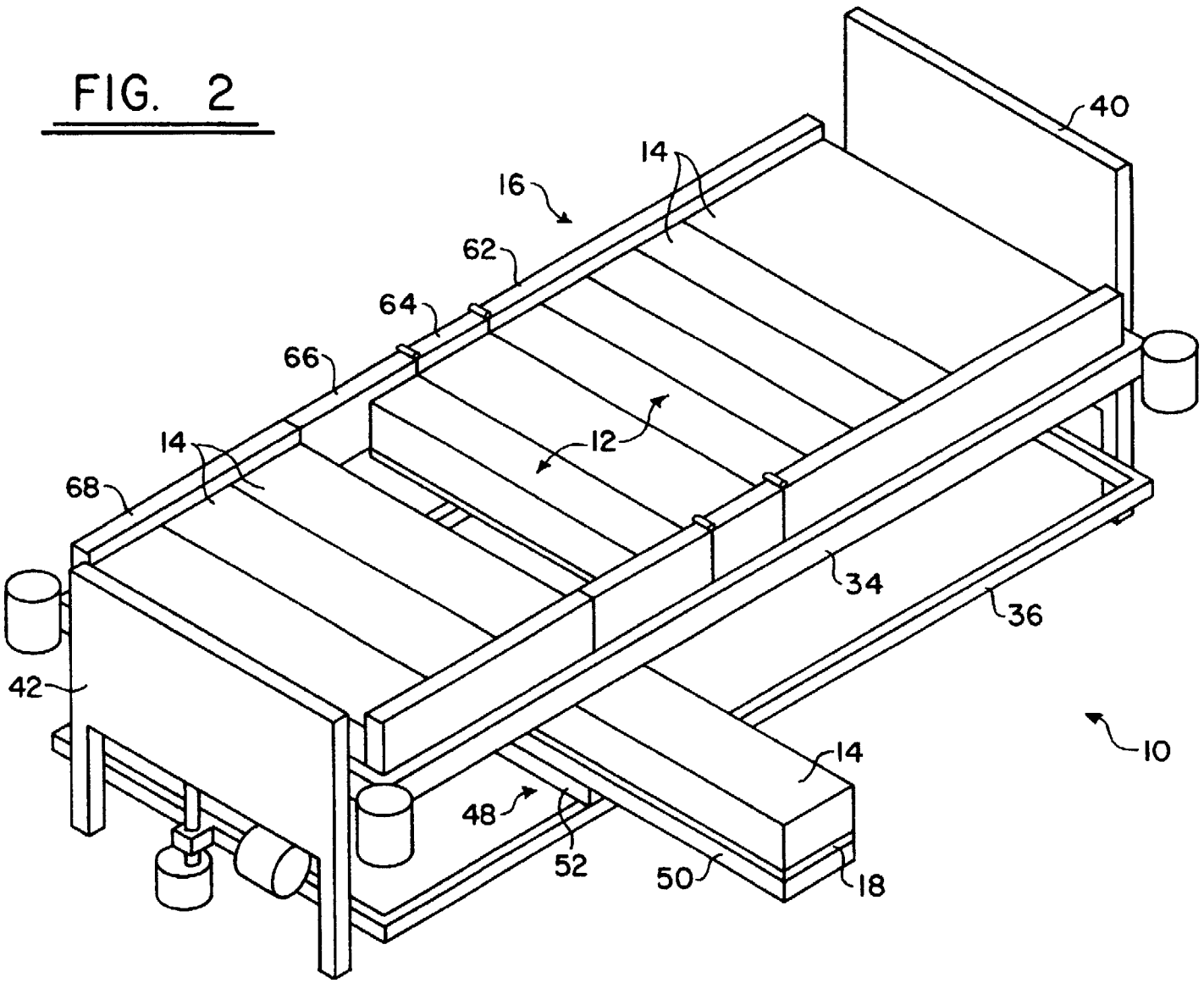
FIG. 2 shows a mattress section in place on a shuttle contained on the traveling frame with the mattress section partially withdrawn in preparation of changing the linen or for some other purpose.
Figure 7:
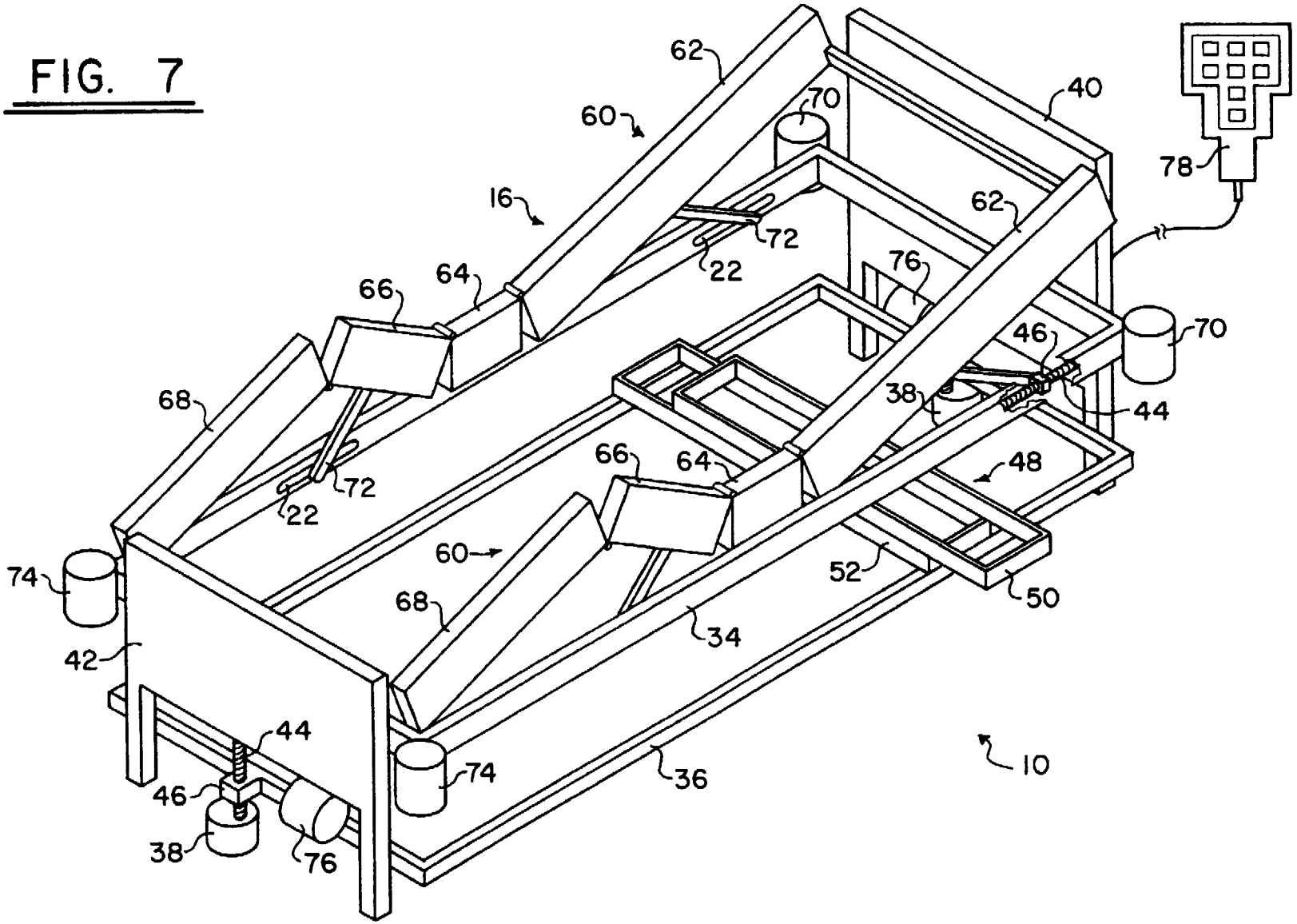
FIG. 7 is a detailed view of the mattress section holder consisting of a pair of oppositely positioned supports constructed of a series of independently movable sections.

Referring to FIGS. 1 and 7, directly under a bedframe 34 there is another frame capable of vertical movement called the traveling frame 36. The up and down movement of the traveling frame 36 is accomplished in a preferred embodiment by two motors 38; one mounted under the headboard 40 and one mounted under the footboard 42. The motors 38 have long screw type shafts 44. A screw shaft 44 and a screw nut assembly 46 (see FIG. 7) is used for linear motion. The motors 38 are mounted so that the screw shaft 44 is perpendicular to the ground. The screw nut assembly 46 of each motor 38 is attached to each end of the traveling frame 36. When the motor 38 shaft turns, the screw nut assembly 46, being attached to both ends of the traveling frame 36, will move the traveling frame 36 upward and/or downward.

Referring now to FIGS. 1, 2, 3, and 4 on the traveling frame 36, there is a shuttle mechanism 48, which can travel horizontally back and forth along the length of the traveling frame 36. The back and forth movement of the shuttle 48 can be controlled either manually or automatically by a position controller 78 (see FIG. 7) to precisely position the shuttle 48 at any desired spot along the length of the traveling frame 36. In the case of manual operation, once the shuttle 48 is manually positioned at the desired spot, it can be manually locked into position by a small locking mechanism 53 which is used to engage position holes 57 in travelling frame 36 (see FIG. 6). An upper section 50 of the shuttle 48 can be manually slid out along its length for about seventy-five percent of its length and at the same time maintain its attachment with a bottom section 52 of the shuttle 48. The upper section 50 can also be manually turned three hundred and sixty degrees in reference with the bottom section (but only a ninety degree turn is needed to accomplish the task described hereafter).

Figure 6B:
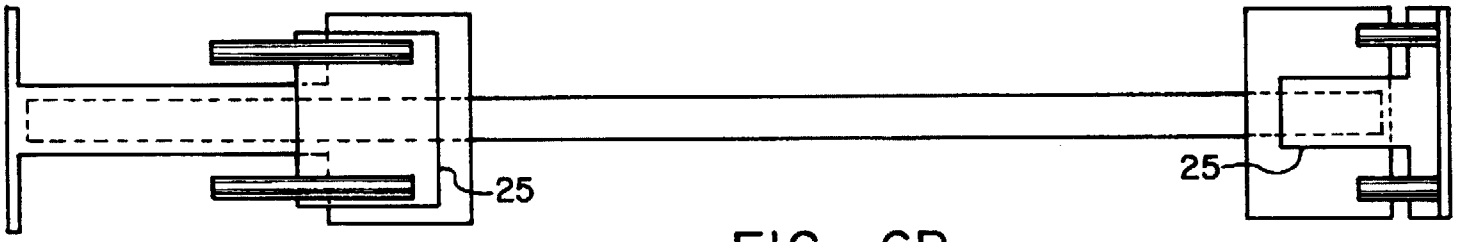
FIG. 6B illustrates the locking mechanism for locking the mattress section to the shuttle.
Figure 6:
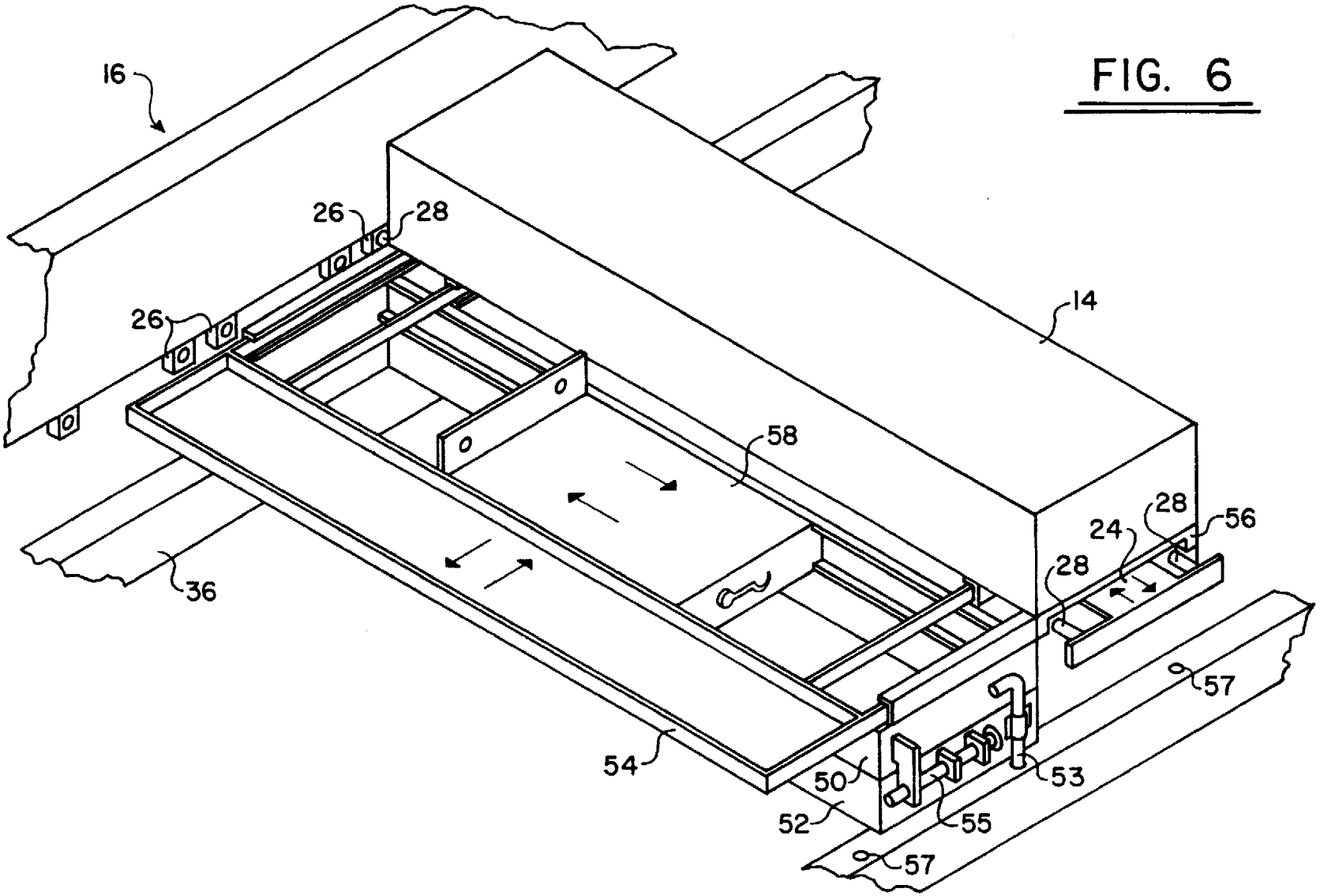
FIG. 6 is a detailed view of the shuttle illustrating wings A and B and the movable platform.

Referring now to FIG. 6, the shuttle 48 has two wings, wing-54 and wing-56 these two wings 54 and 56 are slidably attached by means of linear ball bearings to the upper section of the shuttle 48. Also in the center of the upper section of the shuttle 48, there is a small platform 58 slidably attached by means of linear ball bearings to the shuttle 48. This platform can be slid along the length of the shuttle 48 and can be positioned at any desired spot.

The upper section 50 of the shuttle 48 has four holes on each side (a total of eight) (not shown), so that each mattress section 14 through its own locking mechanism 25 (see FIG. 6B) can be engaged to the shuttle 48 when needed. The shuttle 48 on one end also has a lock 55 (see FIG. 6) that keeps the upper section 50 of the shuttle 48 from unintentional retraction from the bottom section 52.

Referring now to FIG. 7, the mattress section holder 16 is comprised of two supports 60, of four sections each, on each side of the bed. Section 64 is stationary, in a preferred embodiment, and attached to the bedframe 34 and at the same time both of its top corners are hinged to section 62 and section 66. The lower corner of section 66, on the opposite side, is also hinged to one side of section 68 on its lower corner. This combination of attachment of these sections enables the mattress sections 14, when all are attached to the mattress section holder 16, to form the bends and elevations required by a patient utilizing a movable bed.

The movement of the section 62, which is responsible for lifting the patient's upper torso, is accomplished by two motors 70, one mounted on each side of the headboard 40 on the bedframe 34. The motors 70 have long screw type shafts 44 (see FIG. 7). This shaft 44, combined with a screw nut assembly 46 (not shown), creates a linear motion as described with the traveling frame 36. Each motor 70 is mounted at the side of the bedframe 34 such that the screw shaft 44 and screw nut assembly 46 is inserted and situated inside the bedframe 34. There is a narrow rectangular cut 22 (window) on the inner side of the bedframe 34. The length of this cut 22 is one inch longer than the total linear travel length of the screw nut assembly 46. Through this cut 22, a connection is made through the screw nut assembly 46 and a bar 72, hereinafter referred to as "torque bar 72". The other end of the torque bar 72 is attached to support section 62. When the motor shaft 44 turns, the screw nut assembly 46 moves one end of the torque bar 72, which is attached to the screw nut assembly 46 linearly and results in the lifting of the support section 62. The motion of the support section 62 is a circular motion, pivoting around the hinge point between the support sections 62 (see cutaway portion of FIG. 7) and 64.

Similarly, the movement of the sections 66 and 68, which are responsible for the lifting of the thighs and calves, is accomplished by two motors 74, one mounted on each side of the footboard 42 on the bedframe 34. In a similar fashion, the linear movement of a torque bar 72, which is connected at one end to a screw nut assembly 46 and at the other end to section 66, results in the lifting of sections 66 and 68 which are responsible for lifting thighs and calves.

Finally, there are two motors 76, one mounted under the headboard 40 and the other mounted under the footboard 42. These two motors 76 are responsible for lifting the entire bed 10. All motors in this bed 10 are operated, in a preferred embodiment, by a hand held push-button controller 78 (see FIG. 7). The limits of the movements of each of these sections 62, 66 and 68, which lift the upper torso, thighs and calves, are controlled by limit switches known in the art and not disclosed more fully hereafter. However, the movement of these sections can be controlled by the operator's choice within the limits of travel.

As previously mentioned, the purpose of the invention of this sectional bed 10 is to eliminate and/or alleviate four major problems that are associated with bedridden patients: changing linen; bedsores; bathing; and usage of the bedpan. Also as described before, the mattress 12 of the sectional bed 10 of this invention is comprised of a number of mattress sections 14 supported by a mattress section holder 16. Each mattress section 14 has its own linen cover sheet 30. When an individual linen cover sheet 30 of a mattress section 14 is soiled, only that individual linen cover sheet 30 of that particular mattress section 14 needs to be changed. To change the individual linen cover sheet 30, the operator simply positions the shuttle 48 exactly under that particular mattress section 14, either manually or automatically, by pressing a "shuttle positioning" button on a hand held controller 78. Once the shuttle 48 is positioned under the desired mattress section 14, the operator then presses a "shuttle-up" button on the hand held push button controller 78 (see FIG. 7). The type, name and position of the buttons illustrated on push button controller 78 may be of any type known in the art and are not disclosed more fully hereafter. The shuttle 48 is raised until it touches the bottom of the mattress section 14. The operator then releases the button. Then the operator slides the locking mechanism 25 outward about one inch, thereby, releasing the mattress section 14 from the mattress section holder 16 (see FIG. 6B). At the same time, this action engages the mattress section 14 to the shuttle 48. The operator then presses a "shuttle-down" button and lowers the shuttle 48 with the selected mattress section 14 attached (see FIG. 2). At this time, the operator unlocks the upper section 50 of the shuttle 48 from the bottom section 52 of the shuttle 48, and slides the upper section 50 of the shuttle 48 out, together with the attached mattress section 14. The operator then turns the upper section 50 of the shuttle 48 ninety degrees. At this time, the mattress section 14 on the shuttle 48 is outside, away from and no longer underneath, the bed 10 and parallel to the length of the bed 10 (see FIG. 3). The operator then takes the soiled individual linen cover sheet 30 off the mattress section 14, takes the soiled "blue chuck" 32 lying underneath the individual linen cover sheet 30 off, spreads a new "blue chuck" 32 and fits a clean linen cover sheet 30 over the mattress section 14. The individual linen cover sheet 30 is secured the mattress section 14 with hook and loop closures or any other suitable means known in the art. To position the mattress section 14 in its original position, the operator simply performs the reverse of this procedure.

For preventing bedsores, the operator, enabled by the present invention, drops every other mattress section 14 one-by-one, using the shuttle 48 as described above. Each mattress section 14, after it is disengaged from the mattress section holder 16 and lowered by the shuttle 48 will be taken off the shuttle 48, making the shuttle 48 ready for bringing the next mattress section 14 down. Once every other mattress section 14 has been removed, those parts of the patient's body which are over the now empty areas (such as shown in FIG. 3) are free from mattress 12 contact and exposed to air. After a pre-determined period of time, these mattress sections 14 are replaced in their original position and engaged to the mattress section holder 16, one-by-one. Thereafter, the operator will bring the other mattress sections 14 down one-by-one. In this manner, all of the patient's body has the same opportunity to be free of contact with the mattress 12 and to be exposed to air. This task may be accomplished either once a day or as often as necessary to keep the patient's body free of bedsores.

Bathing of the patient may be done at the same time that the mattress sections 14 are removed for the purpose of preventing bed sores. That is, when a few of the mattress sections 14 are dropped for the purpose of airing the patient's body, as described above, the patient may also be bathed. Sponging of the body is enabled by the present invention through the open areas from beneath.

Figure 4:
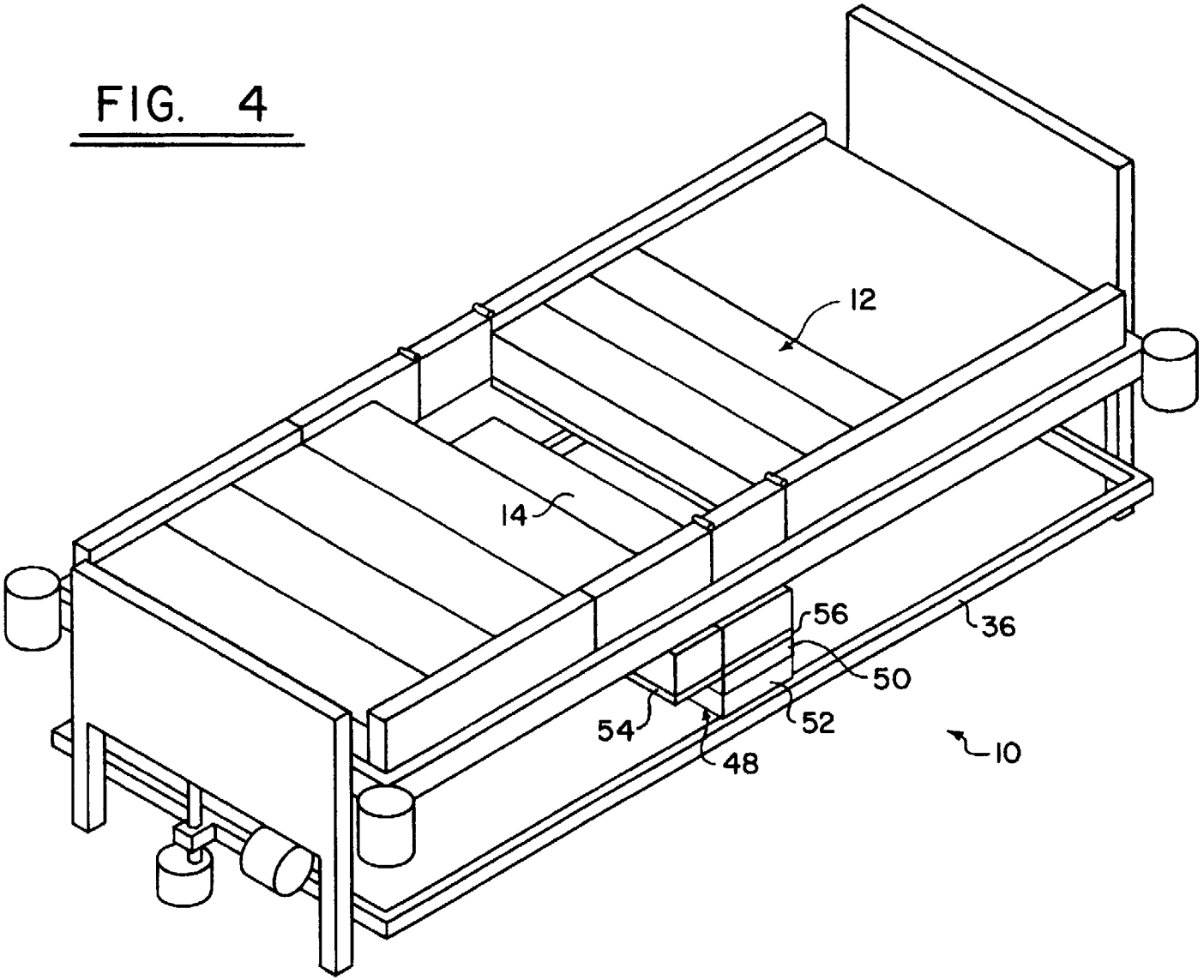
FIG. 4 shows the shuttle in place for removing two mattress sections in anticipation of using a toilet.
Figures 5, 5A:
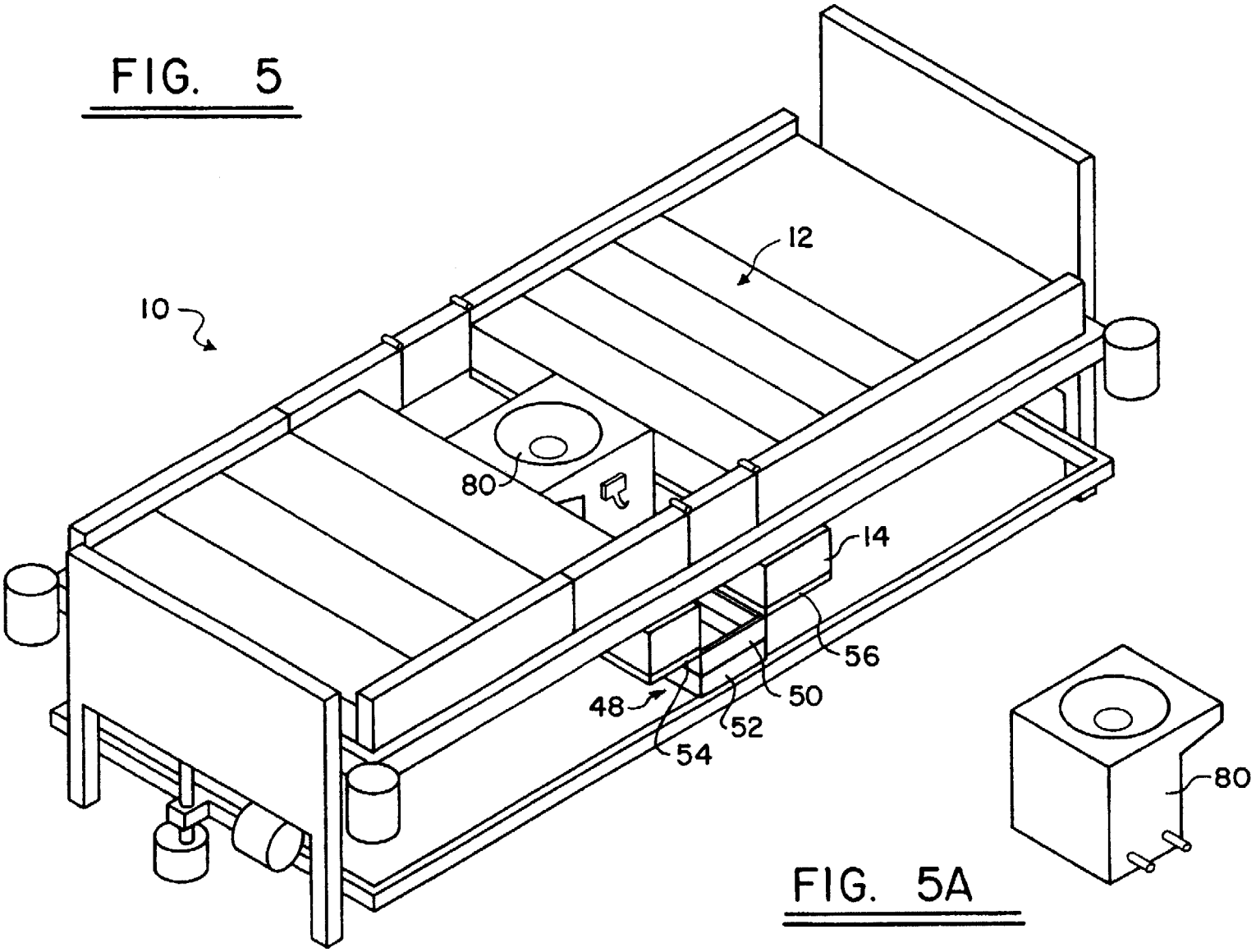
FIG. 5 shows the two mattress sections separated and supported by wings 54 and 56 of the shuttle with a toilet device placed on a stand in the center of the shuttle.
FIG. 5A shows the toilet device.

Using the toilet 80 on this bed 10 is quite different from the standard "bedpan" procedure being practiced with invalids presently. Referring to FIGS. 4 and 5, when the patient needs to use the toilet 80, by means of the present invention, the operator positions the shuttle 48 on the spot exactly under the mattress section 14 which is supported by the stationary support section 64. The operator then extends Wing-54 of the shuttle 48. Wing-54 is positioned exactly under the next mattress section 14. The operator then raises the shuttle 48 and when the shuttle 48 touches these two mattress sections 14, the operator stops the shuttle 48 and pulls the locking mechanism on both mattress sections 14, thus disengaging the mattress sections 14 from the mattress section holder 16 while at the same time engaging them to the shuttle 48. The operator then lowers the shuttle 48 carrying these two mattress sections 14 (see FIG. 4). Now, the operator extends Wing-56 of the shuttle 48, separating the mattress sections 14 from each other, thus creating a space between them to allow the toilet 80 to be slid from the side of the bed 10 and positioned on the top of the platform 58 of the shuttle 48 (as shown in FIG. 5). Then the operator lays the toilet on the platform 58, pushes it against the barrier so that two toilet pins go through two holes on the barrier. (see FIGS. 6 and 5A). He then locks the toilet 80 to the platform 58 by engaging the pivoting hook mounted on the side of platform 58 (see FIG. 6) to the stationery hook mounted on the side of toiled 80 (see FIG. 5). Then he slides the platform 58 carrying the toilet 80 along the length of the shuttle 48 to position the toilet 80 exactly where the patient needs it to be. Then the operator raises the shuttle 48 until the toilet 80 seat touches and presses against the patient thighs and buttocks and until the toilet 80 seat is level with the top of the mattress 12. At this point, the shuttle 48 is stopped. In severe cases, when the patient's upper torso, thighs and calves cannot be moved for any reason, the patient can still use the toilet 80 while in the supine position. Otherwise, the operator will raise the upper torso, thighs and calves to the level desired so that the patient can comfortably use the toilet 80. At the completion of the task, the operator performs the reverse procedure to bring everything to its original position.

While the present invention has been disclosed in connection with the preferred embodiment thereof, it should be understood that there may be other embodiments which fall within the spirit and scope of the invention as defined by the following claims.

I claim:

1. A sectional bed comprising:

a) a bed frame;

b) a moveable mattress section holder frame attached to the bed frame;

c) a plurality of mattress sections independently removably attached to the mattress section holder frame so that as the mattress section holder frame moves so do the mattress sections;

d) a traveling frame attached to the bed frame, said traveling frame having means for allowing vertical movement within and beneath the bed frame; and e) a shuttle means connected to the traveling frame, said shuttle means having means for allowing horizontal movement along the traveling frame for removing and replacing each of the plurality of mattress sections from beneath a patient.

2. The sectional bed of claim 1 wherein said means for allowing vertical movement further comprises two motors, wherein each motor has a long, screw-type shaft and a screw nut assembly.

3. The sectional bed of claim 1 wherein the shuttle means further comprises:

a) a pair of moveable wings for supporting and separating two adjacent mattress sections; and b) a support platform attached to the shuttle means, said support platform having means for allowing horizontal movement along the shuttle means.

4. The sectional bed of claim 3 further comprising a removably attachable toilet connected to the support platform so that the toilet is introduced to the patient from beneath the patient without having to move the patient.

* * * * *

UNITED STATES PATENT AND TRADEMARK OFFICE

CERTIFICATE OF CORRECTION

PATENT NO. : 5,729,849

DATED : March 24, 1998

INVENTOR(S) : Mojtaba Garakani

It is certified that error appears in the above-identified patent and that said Letters Patent is hereby corrected as shown below:

In column 3, line 24, delete "A and B" and insert --54 and 56--.

In column 4, line 65, after the words "can be" and before the word "position" insert the word --manually--.

In Column 5, Line 22, delete the words "(not shown)" and insert in their place the words --(see FIG. 7)--.

In Column 5, Line 38, after the words "support sections 62", please delete the words "(see cutaway portion of FIG. 7)".

Signed and Sealed this

Twenty-eighth Day of July, 1998

*Attest:*

*Attesting Officer*

BRUCE LEHMAN

*Commissioner of Patents and Trademarks*